US005844179A

United States Patent [19]

Walker et al.

[11] Patent Number: 5,844,179

[45] Date of Patent: Dec. 1, 1998

[54] METHOD OF OPERATION FOR DOUBLE-DECK ELEVATOR SYSTEM

[75] Inventors: Joseph C. Walker, Avon; Bruce A. Powell, Canton, both of Conn.

[73] Assignee: Otis Elevator Company, Farmington, Conn.

[21] Appl. No.: 978,948

[22] Filed: Nov. 26, 1997

[51] Int. Cl.[6] ..... B66B 1/18; B66B 1/00

[52] U.S. Cl. ..... 187/382; 187/902

[58] Field of Search ..... 187/382, 380, 187/387, 902

[56] References Cited

U.S. PATENT DOCUMENTS 4,632,224 12/1986 Nowak et al. ..... 187/29 R
5,086,883 2/1992 Schroder ..... 187/127

*Primary Examiner*—Robert E. Nappi

[57] ABSTRACT

An elevator system having a double-deck car (24) normally responds to unanswered up hall calls from intermediate floors with the upper deck (26), except, under one or more conditions, whereby a subsequent stop may be avoided, its lower deck (28) is utilized.

1 Claim, 2 Drawing Sheets

| | FLOOR n | | | FLOOR n+1 | | UPPER DECK STOPS AT |
|---|---|---|---|---|---|---|
| | UP HALL CALL | UPPER DECK CAR CALL | LOWER DECK CAR CALL | UP HALL CALL | UPPER DECK CAR CALL | |
| A: | ANY | Y | ANY | ANY | ANY | n |
| B: | Y | ANY | N | N | N | n |
| C: | Y | N | ANY | Y | ANY | n+1 |
| D: | Y | N | ANY | ANY | Y | n+1 |
| E: | Y | N | Y | ANY | ANY | n+1 |

FIG. 1
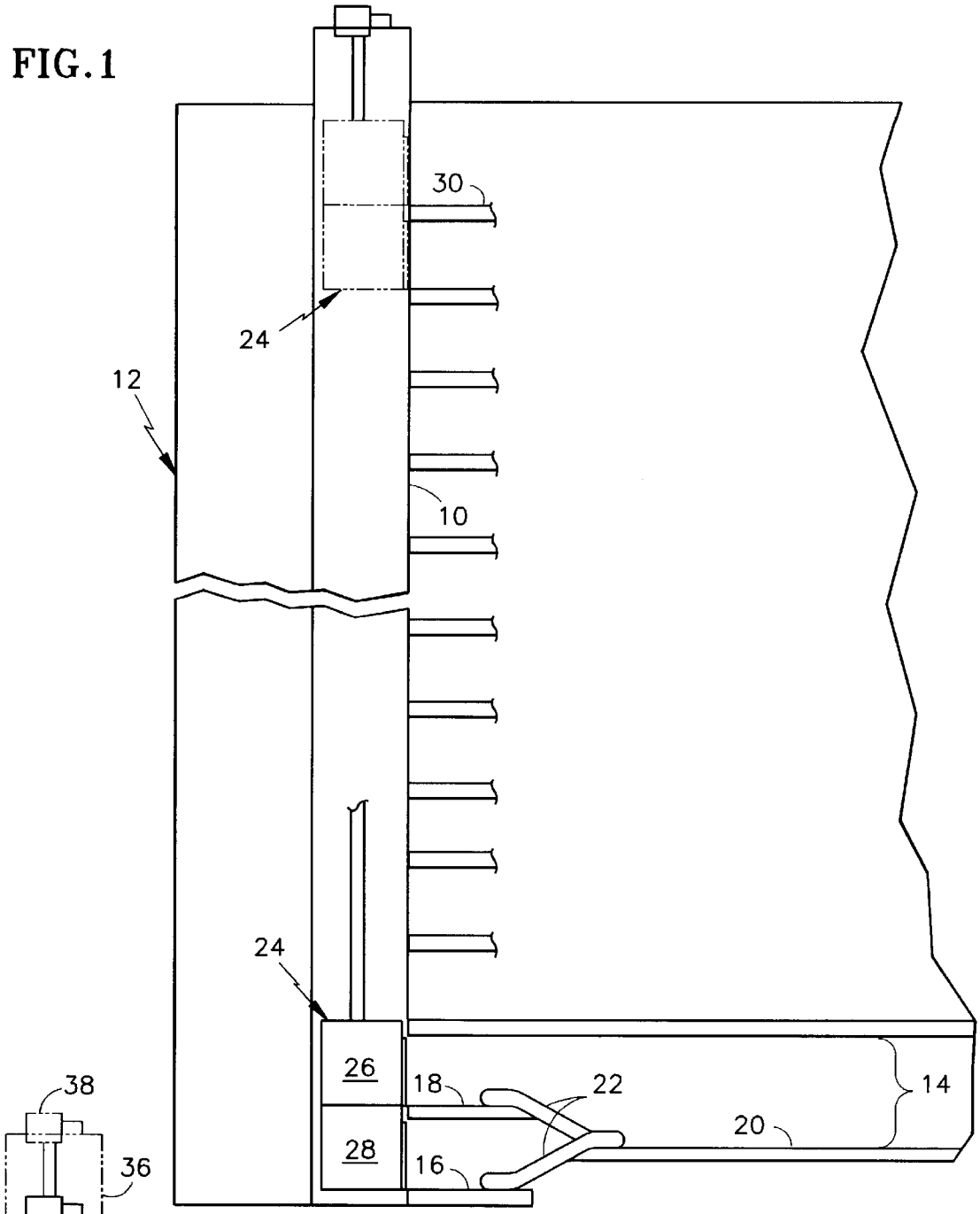
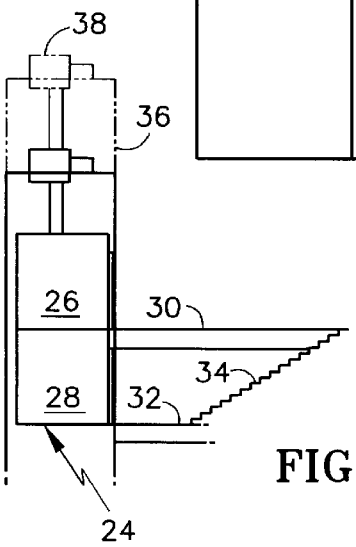
FIG. 3

FIG.2

| | FLOOR n | | | FLOOR n+1 | | UPPER DECK STOPS AT |
|---|---|---|---|---|---|---|
| | UP HALL CALL | UPPER DECK CAR CALL | LOWER DECK CAR CALL | UP HALL CALL | UPPER DECK CAR CALL | |
| A: | ANY | Y | ANY | ANY | ANY | n |
| B: | Y | ANY | N | N | N | n |
| C: | Y | N | ANY | Y | ANY | n+1 |
| D: | Y | N | ANY | ANY | Y | n+1 |
| E: | Y | N | Y | ANY | ANY | n+1 |

METHOD OF OPERATION FOR DOUBLE-DECK ELEVATOR SYSTEM

TECHNICAL FIELD

The present invention relates to a method for operating a double-deck elevator.

BACKGROUND OF THE INVENTION

The use of double-deck elevator systems in high-rise, high volume elevator installations is well known in the building and elevatoring industry. Such elevators provide the ability, particularly during up-peak operation, to transport large numbers of passengers from a lower, bi-level lobby to their destination floors with fewer stops and delays as compared to a single deck elevator system.

During off-peak operation, and in particular, for servicing of intermediate floors in the building, double-deck elevator systems in the prior art are configured so as to answer intermediate floor hall calls by the trailing deck of the system. Thus, as a rule, any up hall call registered at a floor above the lobby levels is answered by the lower or trailing deck of the next upward moving elevator. The benefits of this prior art method include the ability to answer a simultaneous hall call at the next adjacent floor by means of the upper or leading deck.

One disadvantage, however, to the prior art system relates to buildings wherein there is a significant amount of traffic between intermediate floors and the uppermost building floor. In such situations, an upwardly traveling passenger from an intermediate floor may likely be riding on the lower elevator deck. For lower deck passengers having as a destination the topmost floor, there are only two possible choices: 1) to configure the elevator system so as to permit the lower deck to stop at the topmost floor, thus servicing the floor directly, or 2) to stop the upper deck at the topmost floor and the lower deck at the penultimate floor, and provide the passenger with alternate means, such as stairs, escalator, etc., to move from the penultimate floor to the topmost floor.

Both choices have drawbacks, the first in that it requires an extended overhead for the elevator hoistway to permit the upper deck to rise above the topmost floor, and for the second in that it requires the passenger to complete the trip to the topmost floor after exiting from the elevator. What is needed is a method of operating the elevator system which both reduces the number of post-ride passenger trips between the penultimate floor and the topmost floor and avoids requiring an extended overhead in the elevator hoistway.

DISCLOSURE OF THE INVENTION

The present invention relates to a method for operating a double-deck elevator system in the upward direction that reduces the inconveniences to passengers during certain intra-building trips, and in particular, trips from an intermediate floor above the lobby levels to the topmost floor.

According to the present invention the leading, or upper, deck of the elevator car answers all up hall calls when servicing the upward traveled direction, except in the three circumstances noted below. By servicing the upward hall calls with the upper deck, the method according the present invention thus collects most of the upward passengers in the leading deck, thereby providing direct service to the topmost destination floor without requiring an extended overhead space in the hoistway as would be necessary if providing direct service to the topmost floor via the lower deck.

The exceptions to the above general rule occur when the combination of unanswered up hall calls and upper and lower deck car calls for the upcoming floors occur at adjacent floors, thereby permitting the two elevator decks to simultaneously service two floors with a single stop. The three exceptions to the above general rule are: 1) the simultaneous occurrence of up hall calls at adjacent first and second floors, 2) the occurrence of an up hall call at a first floor and an upper deck car call at the next upwardly adjacent floor, and 3) a hall call at a first floor and a simultaneous lower deck car call for the same floor. Under any one of these three exceptions, the upper deck would bypass the subject upcoming hall call at the first floor, which would then be serviced by the elevator's lower deck. As noted above, these three exceptions would cause the combination of two hall calls or a car call and a hall call to be answered by the elevator with a single stop.

The system thus provides, for most intra-building hall calls having the upper most floor as a destination, the ability to service such floor directly. For passengers boarding under the three noted exceptions, only those serviced by the lower deck and having an uppermost floor destination would suffer the inconvenience of having to complete their trip via stairs or escalator.

BRIEF DESCRIPTION OF THE DRAWINGS

FIG. 1 shows an overall schematic of a double-deck elevator system.

FIG. 2 shows a logic table of the method of operation according to the present invention.

FIG. 3 shows a detailed view of the topmost and penultimate floors of a building serviced by a double-deck elevator system.

BEST MODE FOR CARRYING OUT THE INVENTION

Referring now to the drawing Figures, and in particular to FIG. 1, the method for operating a double-deck elevator system according to the present invention will be described. FIG. 1 shows a schematic detail of a double-deck elevator system comprising a hoistway 10 disposed with the building 12 and including a lower lobby area 14. The lobby area 14 is split into first and second levels 16,18 which are connected to the building entrance level 20. As shown in FIG. 1, escalators 22 provide means for moving upwardly traveling passengers entering the building at 20 between upper and lower lobby levels 18,16. Passengers would split in the lobby area 14 based upon their intended destination floors, for example, odd floors to the lower level 16, even floors to the upper level 18. Thus, each traveler originating his or her trip from the lobby levels 14 will enter the double-deck elevator car 24 at either the upper deck 26 or the lower deck 28, depending upon their intended destination. The individual decks 26,28 will thus service the proper destination floors for each of the lobby originating passengers.

Elevator systems, and in particular the double-deck elevator system illustrated herein, respond to combinations of hall calls and car calls as described hereafter. Car calls are defined as destination inputs provided by passengers by means of the car operating panel installed on each deck of the double-deck elevator. Entering passengers typically press a destination floor button on the car operating panel thus informing the elevator system controller of the destination of the passengers on each deck of the elevator. Hall calls are received from the elevator call panel typically located near the elevator hall doors. The hall panel consists of an up call button and a down call button or the like. Passengers calling the elevator press the button indicating the direction they wish to travel entering their destination on the car operating panel after entering the called elevator.

As discussed in the preceding section, travelers to the topmost floor 30 may experience difficulty in directly reaching such floor if their individual trips originate at a floor other than the lobby levels 14. As also noted in the preceding background section, the typical method for servicing up hall calls from non-lobby level floors is to answer such calls with the trailing, or lower deck 28. Under such circumstances, a traveler from an intermediate floor attempting to reach the topmost floor 30 may be forced to exit on the penultimate floor 32 and proceed independently to the topmost floor 30 by means of stairs 34, escalator or other means. See FIG. 3.

One solution to this undesirable transfer is to permit the lower deck 28 to service the topmost floor 30 by means of an extended overhead 36, as shown in phantom in FIG. 3. The extended hoistway overhead 36 requires the elevation of the elevator machine, drive, and other associated equipment from the top of the hoistway an additional distance upward in order to permit the upper deck 26 to be raised above the topmost floor 30. While permitting direct service to the topmost floor 30 by the elevator lower deck 28 the extended overhead space and structure 36 is undesirable from the standpoint of cost, aesthetics, and other reasons.

The present invention reduces the likelihood that an upward traveling passenger attempting to reach the topmost floor 30 will be forced to exit on the penultimate floor 32 and be required to transfer to the topmost destination floor 30. This is accomplished by operating the elevator system so as to answer up hall calls with the leading, or upper deck 26 except under the occurrence of three specific conditions.

The three conditions are: 1) the occurrence of two unanswered up hall calls at adjacent floors, 2) the occurrence of an up hall call at floor n and an upper deck car call for floor n+1, and 3) the occurrence of an up hall call at floor n and a lower deck car call, also at floor N. In each of these three exceptions, two simultaneously occurring calls may be answered by a single stop of the elevator. Under each of these three exceptions the upper or leading elevator deck would bypass the first (or only) unanswered hall call, and answer such call with the lower deck.

FIG. 2 shows a logic table detailing the response of the elevator system according the present invention for an upwardly traveling car responding to the combination of upper and lower deck car calls and hall calls originating from an intermediate floor n and the next upwardly adjacent floor n+1.

Line A merely shows that, in the event of an upper deck car call for floor N, the system will stop the upper deck at floor n regardless of the existence of any other combination of hall calls or lower and upper deck car calls.

Line B is the default operation mode wherein an up hall call at floor N, in the absence of a lower deck car call for floor n and neither an upper deck car call nor an up hall call for floor n+1, results in the upper elevator deck stopping at floor N.

Lines C, D and E note exceptions to the Line B default mode of operation. For exceptions C, D and E, an up hall call is registered on floor N, and the elevator upper deck stops at floor n+1 as shown. The exceptions relate to the combinations of the up hall call at floor n with C and up hall call at floor n+1, D an upper deck car call for floor n+1, and E a lower deck car call for floor N.

In each case, C, D and E, the single stop of the elevator with the upper deck at floor n+1 enables the elevator to clear both the up hall call on floor n and either the up hall call on floor n+1, or the upper deck car call for floor n+1 or the lower deck car call for floor n with a single stop. It will be observed by those skilled in the art that, in the absence of the exception mode of operation shown in Lines C, D and E the default mode of operation proposed according to the present invention would have caused the elevator to stop twice, once with the upper deck at floor n and again with the upper deck at floor n+1.

As will be appreciated by those skilled in the art, answering up hall calls with the upper deck 26 causes the upper deck to accumulate passengers, including those destined for the topmost floor 30, thereby resulting in direct service for those trips originating at other than the lobby level 14. Overall elevator performance is not compromised by the alteration of the prior art method as the three recited exceptions permit the elevator to service two simultaneous car and or hall calls with a single stop. Both these and other objects and advantages of the present invention will be apparent to those skilled in the art upon review of the foregoing specification and the appended claims and drawing Figures.

Various changes to the above description may be made without departing from the spirit and scope of the present invention as would be obvious to one of ordinary skill in the art of the present invention.

What is claimed is:

1. A method of operating a double-deck elevator having an upper deck and a lower deck for simultaneously servicing two adjacent floors, said elevator being receptive to car calls from the upper deck and car calls from the lower deck, and up hall calls from individual floors comprising the steps of:

answering all up hall calls by stopping the upper deck of the elevator coincident with the floor corresponding to each call when said elevator is operating in an upward service condition, except under the occurrence of at least one of the following conditions:

a) the occurrence of two unanswered up hall calls at adjacent first and second floors, b) the occurrence of an up hall call at a first floor, and an upper deck car call for a second floor, said second floor being upwardly adjacent said first floor, and c) a hall call at a first floor and a lower deck car call for said first floor, and whereby, upon the occurrence of at least one of said conditions, said elevator is operated to service said first floor with said lower deck and said second floor with said upper deck during a single stop of the elevator.

* * * * *